US006390957B1

(12) United States Patent
Knight

(10) Patent No.: US 6,390,957 B1
(45) Date of Patent: May 21, 2002

(54) LEG EXERCISING APPARATUS

(76) Inventor: Jeffrey E. Knight, 8230 Main St., Williamsville, NY (US) 14221

( * ) Notice: Subject to any disclaimer, the term of this patent is extended or adjusted under 35 U.S.C. 154(b) by 0 days.

(21) Appl. No.: 09/487,933

(22) Filed: Jan. 20, 2000

(51) Int. Cl.[7] ..... A63B 21/02

(52) U.S. Cl. ..... 482/79; 482/124; 482/99; 482/121

(58) Field of Search ..... 482/99, 102, 103, 482/139, 124

(56) References Cited

U.S. PATENT DOCUMENTS 1,543,346 A * 6/1925 Tituts ..... 482/124
4,685,671 A * 8/1987 Augerman et al. ..... 482/124
5,242,347 A * 9/1993 Keeton ..... 482/102
5,558,604 A * 9/1996 Olschansky et al. ..... 482/122
5,626,544 A * 5/1997 Foresto ..... 482/124
5,782,727 A * 7/1998 Pierce ..... 482/129

* cited by examiner

*Primary Examiner*—Jerome W. Donnelly
(74) *Attorney, Agent, or Firm*—James J. Ralabate

(57) ABSTRACT

An exercise apparatus for exercising, strengthening and conditioning the tibial and ankle areas of the leg, shin as comprises a first strap adapted to form a loop around the foot of a user, passing across the underside of the foot in the region of the ball of the foot. A metal ring is slidably attached to the underside portion of the strap to connect to an exercise resistance, such as a pulley system weight rack or an elastic cord. The first strap is held in place with the aid of a second strap extending along each side of the foot and around the heel portion and connecting at each side to the first strap.

1 Claim, 3 Drawing Sheets

LEG EXERCISING APPARATUS

BACKGROUND OF THE INVENTION

1. Field of the Invention

This invention relates to exercising devices and, in particular, to an apparatus for exercising, conditioning and strengthening the muscles and tendons in the leg.

2. Brief Description of the Prior Art

Deterioration or injury of the lower leg area as an effect of aging or from an accident or athletic injury commonly requires physiotherapy and the use of specific apparatus designed to exercise and condition the injured or deteriorated muscles. Furthermore, such apparatus may be used by athletes or others for strengthening or conditioning healthy muscles to inhibit weakening or injury under stress. The apparatus may involve the attachment of weights or other resistance to the leg, especially the foot, to provide a variable weight resistance during the exercising of the muscles. Various devices for this purpose are known in the literature. Furthermore, various other devices and apparatus for attachment to the foot area of a user for purposes other than exercise, are known.

U.S. Pat. No. 3,214,850 to McNair discloses a strapping device for holding ice cleats on to a user's foot to provide traction as the wearer walks across a slippery surface, such as ice. U.S. Pat. No. 4,302,890 to Covell et al discloses an anti-slipping attachment to be placed over shoes and held in place by adjustable straps. U.S. Pat. No. 5,722,919 to Timmer discloses an ankle strengthening and rehabilitation device comprising a foot plate attachable by adjustable straps to a user's foot and having a fastener for attaching weighted discs or a proprioception balance element. U.S. Pat. No. 5,836,857 to Jennings discloses an apparatus for applying lateral force to the leg joints of a person. The apparatus comprises a cuff to hold the leg of a user and means to attach the cuff to a substantially stationary object, such as a heavy piece of furniture.

SUMMARY OF THE INVENTION

It is an object of the present invention to provide an exercise apparatus for use in strengthening and conditioning the medial, lateral, and anterior muscles and tendons of the leg, especially the tibial and ankle areas.

It is a further object to provide an apparatus for exercising the muscles and tendons of a user's lower leg that is of simple construction and adapted for convenient use either in professional exercise or physiotherapy facility or in the user's home.

The above and other objects are accomplished in accordance with the present invention which provides an exercise apparatus comprising a first strap adapted to encircle the foot of a user, passing across the underside of the foot in the region of the ball of the foot; a second strap adapted to extend around the heel and along each side of said foot and attached at each end to the first strap; a coupling means on the first strap, positioned at the underside of the foot to permit the convenient attachment of an exercise resistance means; and an exercise resistance means attachable thereto.

The straps may be made of various strong, flexible materials such as leather, cloth webbing, woven fabric, or various plastic materials, preferably nylon, and the like. The straps may be made of a moderately stretchable material such a rubber or plastic material, to slip securely over the user's foot. However, in a preferred embodiment, both the first and second strap include adjustable fastening means, such as hook and loop fasteners, buckles and the like, to allow adaptation to various foot sizes, and use on bare feet as well as on various types of footgear, such as shoes, slippers, boots, athletic shoes and the like to allow the apparatus to be easily and conveniently secured to a user's foot and to maintain the apparatus securely in place during exercise. The preferred adjustable fastening means are hook and loop fasteners.

The coupling means may take the form of a securing loop, encircling the first strap at the underside thereof, such as a metal or plastic loop or ring, snap hook, or other device to which the exercise resistance means may be securely, but removably attached. In another embodiment, the coupling means may constitute one or more holes, preferably three, in the strap, optionally reinforced such as by a metal grommet, to permit the attachment of an exercise resistance device. Optionally, a metal or plastic ring or loop may be attached to each hole to provide a more convenient coupling or attachment means. Alternatively, the attachment of an exercise resistance device may be made by simply hooking or tying the exercise resistance device, or a cord extended therefrom, directly to the underside of the first strap.

Various exercise resistance means or devices may be employed and attached to the exercise apparatus. For example, an exercise resistance device such as a pulley system weight rack providing an adjustable weight system for varying resistance requirements may be employed. Various other exercise resistance or tension devices may be employed, such as an elastic cord attached at one end to the coupling and at the other end to a stationary unit, such as a wall of a room. The preferred exercise resistance device, especially for convenient use in a user's home, is a bungee cord.

The coupling means provides a secure attachment but is adapted to slide or be repositioned to allow its use in various directions with respect to the exercise resistance means, allowing foot movement in different directions to exercise different muscles and tendons. If holes in the strap are used as the coupling means, it is preferred to position a hole in the center region and one near each side to allow the positioning of the attached exercise resistance device to be varied depending on the particular exercise intended.

BRIEF DESCRIPTION OF THE DRAWINGS

To further illustrate the present invention and the manner in which it may be practiced, reference is made to the accompanying drawing wherein.

DETAILED DESCRIPTION

Figure 1:
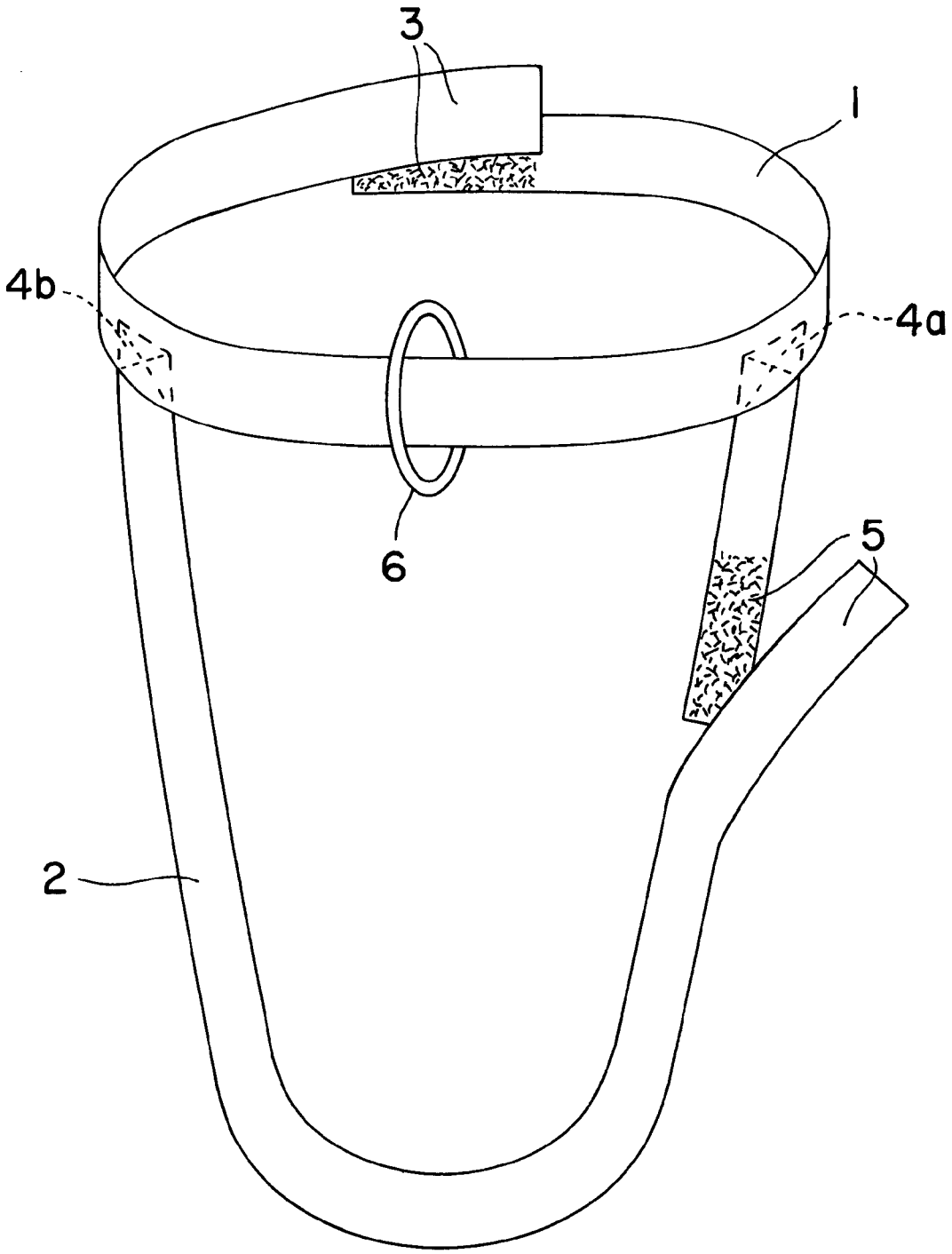
FIG. 1 is a perspective view of an exercise apparatus of the invention.

With reference to FIG.1, the exercise apparatus of the present invention comprises a first strap 1 adapted to be positioned in a loop around the forward region of a user's foot and a second strap 2 adapted to extend along each side of the foot and around the heel of the user. The two ends of second strap 2 are attached to the first strap 1, for example, by sewing, riveting, or other means as at 4*a* and 4*b* on each side. In a preferred embodiment, each strap has an adjustable fastening means for maintaining the apparatus securely on the foot during exercise. In the embodiment shown, the first strap 1 is adjustably secured with the aid of hook and loop fastener 3 and second strap 2 is adjustably secured by means of hook and loop fastener 5.

Figure 2:
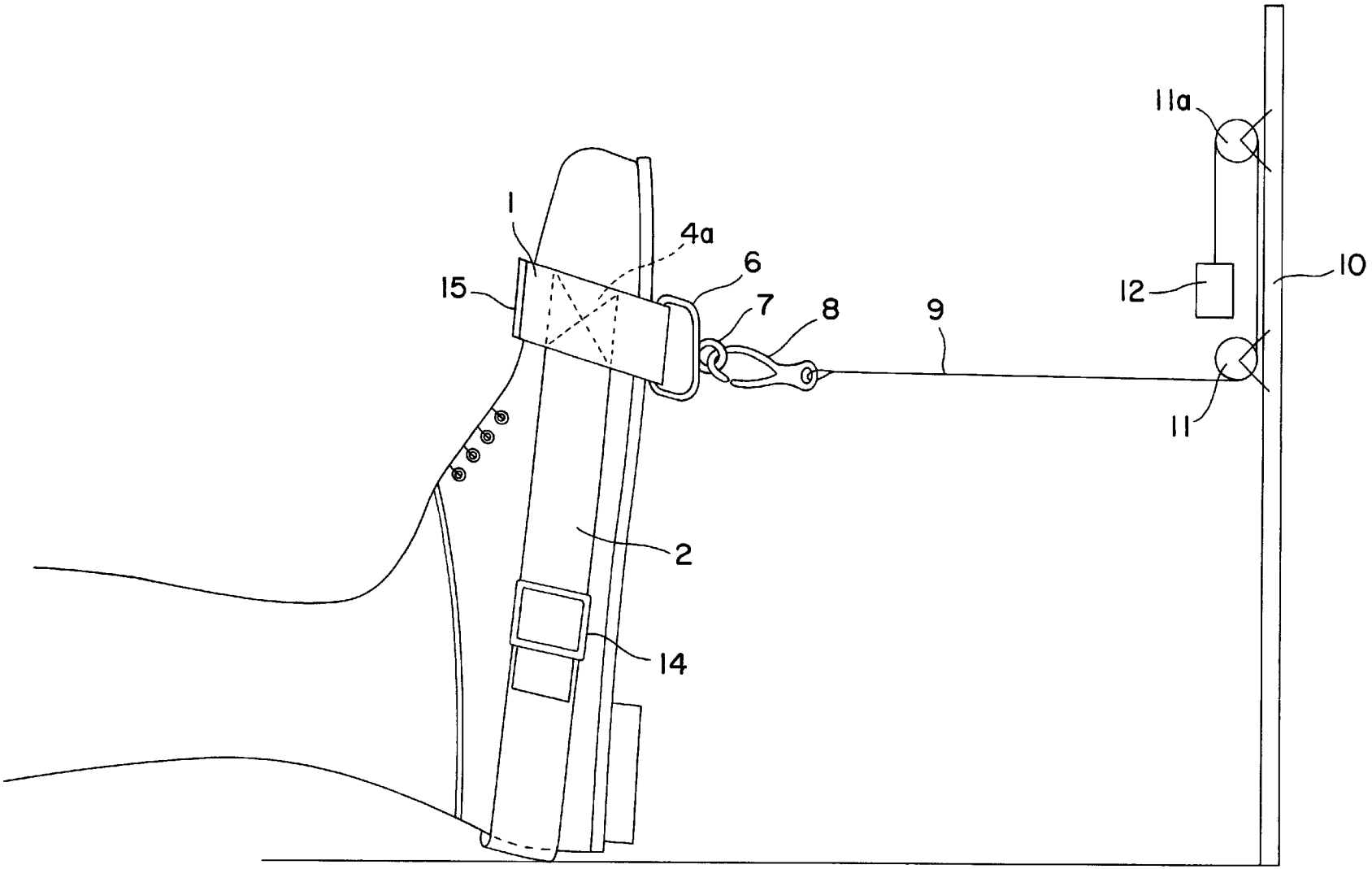
FIG. 2 is a side elevational view of an exercise apparatus of the invention, in place around the foot of a user attached to an exercise resistance, and positioned for exercising the muscles and tendons of the leg by dorsiflexion and plantarflexion motions.
Figure 3:
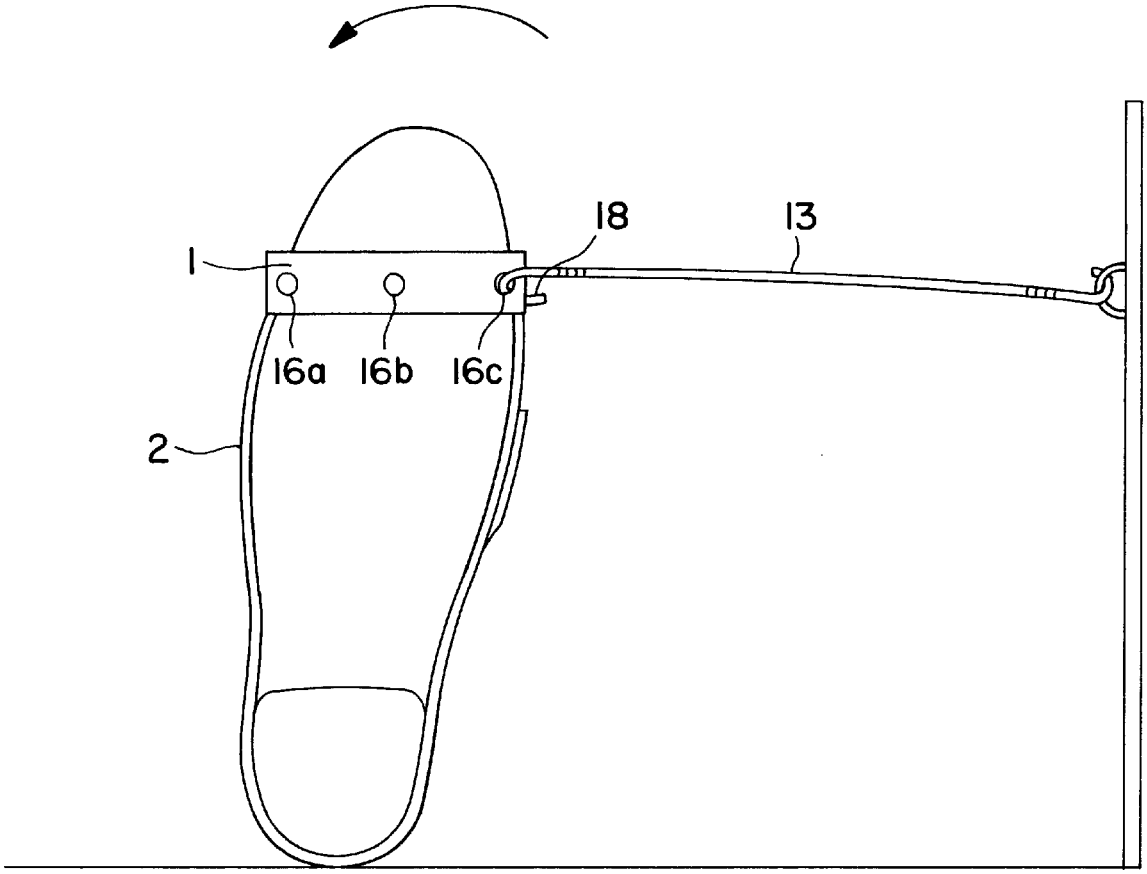
FIG. 3 is a bottom view the apparatus of the invention in position around the foot of a user with the foot oriented in a direction for exercising the muscles and tendons of the leg by eversion and inversion of the foot in a movement perpendicular to the body of the user.

The exercise apparatus may be secured around the foot of a user in the manner depicted in FIGS. 2 and 3. In use, the first strap 1 encircles the foot of the user, passing across the underside of the foot in the region of the ball of the foot and adjustably secured to itself by means of a fastener, such as a buckle 15 (FIG. 2), or preferably, a hook and loop fastener 3 (FIG. 1). The first strap 1 is held in place by means of second strap 2 which extends along each side of the foot and around the heel of the user. The second strap 2 may also be adjustably secured by means of a fastener, such as buckle 14.

On the underside of first strap 1 in the region of the ball of the foot, a slidable securing loop 6, encircles strap 1, optionally with an attached fastening ring 7, to provide an attachment point for an exercise resistance means, such as an adjustable weight pulley system 10 (FIG. 2) or a bungee cord 13 (FIG. 3). The adjustable weight system 10 in FIG. 2, is connected to securing loop 6 by a spring clip 8 and cord 9 which, in turn is connected to weight 12 by means of pulleys 11 and 11*a*.

In the embodiment depicted in FIG. 3, holes 16*a*, 16*b*, and 16*c* are the coupling means to which hook 18 of bungee cord 13 may be attached. In the particular embodiment shown, the attachment is made at hole 16*c* near the inner side of the user's foot to permit an exercise involving an eversive motion of the foot, in the direction shown by the arrow.

Although the embodiment depicted in FIG. 2 shows the use of a securing loop 6 and spring clip 8 as a coupling means to connect to the adjustable weight system 10, it will be understood that various other attaching means may be employed. Thus, for example, in a very simple form, the cord 9 could be directly attached by simply looping around the strap 1 and tying in place. In a similar fashion, a hook, such as hook 18 at an end of the bungee cord 13 as depicted in FIG. 3, could be hooked directly to strap 1, with or without the use of securing loop 6. Optionally, holes, such as holes 16*a–c*, may be provided and positioned to accept hook 18 at a position suitable for the direction of motion to be used in a particular exercise. It will be appreciated by those skilled in the art that various other coupling means may be used to accomplish the purpose. It is preferred, however, that the coupling means permit the apparatus to be used in various directions to permit the exercising of various muscles in the tibial and ankle regions. In the illustration of FIG. 2, the user is positioned to exercise the muscles involved in flexing the foot in a direction parallel to the user's leg. In a different orientation, as in FIG. 3 (90 degrees from the position shown in FIG. 2) the user may be positioned to exercise the muscles involved in inversive or eversive movement of the foot against the resistance of the exercise resistance device.

Various other arrangements may be made for exercising other areas of the leg or for convenience in attaching the exercise resistance means. Thus, for example, an elastic cord, such as a bungee cord, could be looped around a leg of a heavy piece of furniture and both hooks attached to securing loop 6 or directly to strap 2. Furthermore, the exercise apparatus may used from various positions. For example, the user may be in a standing position, or sitting in a chair, or sitting or lying on the floor during exercise.

Figure 4:
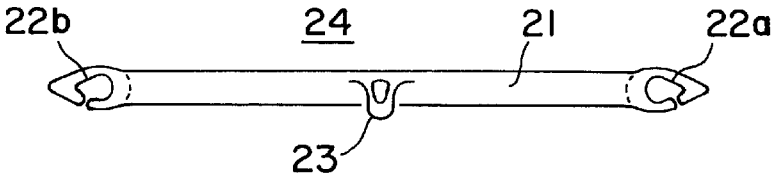
FIG. 4 illustrates a yoking device for use in the present invention to permit the exercising of both legs of the user at the same time, especially for the dorsiflexion and plantarflexion motions.

In another embodiment of the invention, a yoke 24, as shown in FIG. 4, may be employed to allow the exercise of both of a user's legs at the same time. Yoke 24 comprises a rigid bar 21, made, for example, of wood, metal plastic or the like, having an attachment means, such as clips 22*a* and 22*b*, which may be of metal, plastic, or other suitable material, at each end, and a centrally positioned attachment means, such as ring 23. In use, clips 22*a* and *b* are attached respectively to strap 1, for example at securing loop 6 of the exercise apparatus on each of the user's feet and the exercise resistance device is attached at ring 23.

Although the invention has been described with reference to certain embodiments thereof, it will be appreciated by those skilled in the art that modifications and variations may be made without departing from the spirit and scope of the invention as defined in the appended claims.

What is claimed is:

1. An exercise apparatus for use in exercising the muscles and tendons of both of a user's legs at the same time, comprising:

A) two exercises apparatuses, each comprising;

a first strap adapted to form a loop around a foot of the user passing across the underside of the foot in the region of the ball of the foot, said first strap being adjustably securable on the upper side thereof and having a coupling means at the underside thereof for the attachment of an exercise resistance means thereto; and a second strap adapted to extend around the heel portion and along each side of the foot of the user and attached at each end to said first strap; said second strap being adjustably securable along a side portion thereof;

B) a yoke comprising a rigid bar having an attachment means at each end thereof for attachment to said coupling means of said exercise apparatuses, and a centrally positioned fixed coupling means for the attachment of an exercise resistance means;

C) an exercise resistance means attachable to said fixed coupling means.

* * * * *